US006031167A

United States Patent [19]

Gaston

[11] Patent Number: 6,031,167

[45] Date of Patent: Feb. 29, 2000

[54] CUSHION FOR PLUCKED STRING INSTRUMENT

[76] Inventor: Victor D. Gaston, 3521 S. Parkview, Oklahoma City, Okla. 73119

[21] Appl. No.: 09/307,025

[22] Filed: May 7, 1999

[51] Int. Cl.[7] ..... G10D 3/00

[52] U.S. Cl. ..... 84/327

[58] Field of Search ..... 84/327, 279, 280, 84/278; D17/20

[56] References Cited

U.S. PATENT DOCUMENTS

| | | | |
|---|---|---|---|
| 3,979,993 | 9/1976 | Proctor | 84/327 |
| 4,966,062 | 10/1990 | Driggers et al. | 84/327 |
| 5,388,492 | 2/1995 | Olson | 84/327 |
| 5,817,961 | 10/1998 | Beck | 84/327 |

*Primary Examiner*—Brian Sircus
*Assistant Examiner*—Kim Lockett
*Attorney, Agent, or Firm*—Robert K. Rhea

[57] ABSTRACT

An L-shaped cushion for use with a stringed instrument having a concave lower surface in a body portion when the instrument is in playing position, is formed by a base pad containing a concavo-convex member overlying resilient foam material interposed between the musical instrument and a user's thigh for supporting the mass thereof. The leg pad of the L-shaped cushion similarly includes mass distributing planar plates and foam material interposed between the user's torso and the body of the instrument when in playing position.

5 Claims, 1 Drawing Sheet

CUSHION FOR PLUCKED STRING INSTRUMENT

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to plucked string instruments such as a guitar or bass and more particularly to a pad supporting the mass of an electric guitar on the leg of a musician.

1. Field of the Invention

Electric guitars are frequently played while a musician is in a seated position, and the instrument is disposed in a generally edgewise position extending across a thigh of the musician. When sitting and playing for long periods of time the mass of the instrument, being disposed in a relatively small area on a musician's thigh, becomes unbearable or at least very uncomfortable. This invention alleviates this discomfort by providing a padded cushion which is interposed between the musical instrument and the upper surface of the musician's thigh.

2. Description of the Prior Art

U.S. Pat. No. 3,979,993 issued Sep. 14, 1976 to Proctor for SUPPORT CUSHION FOR PLUCKED STRING INSTRUMENT is believed to be the most pertinent patent relating to the invention.

This patent discloses a cushion having an oblique upper edge surface which is interposed between the under surface of a plucked string instrument, such as a guitar, and the thigh of the performer. The cushion yields to the configuration of the stringed instrument and the user's thigh in order to distribute the mass of the instrument on the user's leg. The cushion is disclosed as being attachable as by straps to the leg of the user.

U.S. Pat. No. 4,966,062 issued Oct. 30, 1990 to Driggers et al for GUITAR SUPPORT APPARATUS, and U.S. Pat. No. 5,388,492 issued Feb. 14, 1995 to Olson for L GUITAR SUPPORT are believed good examples of the further state-of-the-art. Each of these patents disclose a musician's thigh overlying base portion and an upstanding arm extending upward from one end of the base to the undersurface of the musical instrument. Both end portions of the musical instrument support are attached to the guitar by suction cups to distribute the mass thereof to an arc of the musician's leg.

This invention is believed distinctive over the above named and other patents by providing hingedly connected pads forming an L-shaped configuration when in use, having a foot portion provided with a concavo-convex rigid inner member which conforms to the user's thigh upper surface and distributes mass applied thereto by a stringed instrument with the other upstanding leg portion of the pad interposed between the bottom surface of the stringed instrument and the torso of the musician.

BRIEF SUMMARY OF THE INVENTION

A generally L-shaped member having a foot portion forming a base pad, generally square in top plan view, includes a quilted material outer surface having an interior transversely containing a concavo-convex rigid section of material, such as plastic, overlying a coextensive section of resilient padding material such as foam rubber, or the like. The leg portion of the L-shape similarly comprises an elongated upstanding pad of similar material hingedly connected longitudinally to the base pad as by stitching together the fabric of the ends of the respective pads. The leg pad similarly contains planar plates of rigid and dense foam material, and a section of foam padding material interposed between the planar plates and the inner surface of the fabric material adjacent the position of a user's torso when in use.

The principal object of this invention is to provide a cushion like pad having a mass bearing end portion distributing the mass of a musical instrument overlying a thigh of a musician's leg and integrally connected with a similar mass distributing portion interposed between the musical instrument and a user's torso.

DETAILED DESCRIPTION OF THE INVENTION

Figure 6:
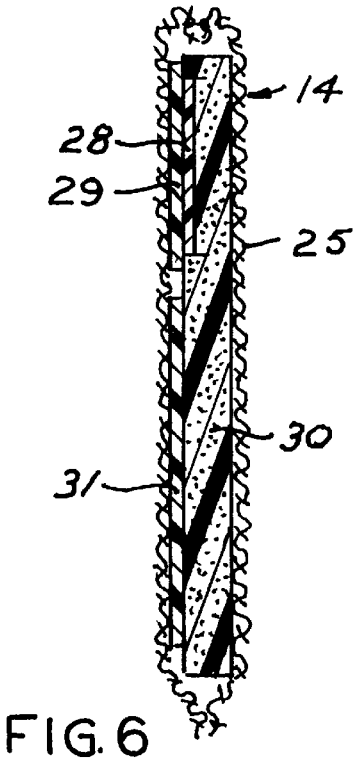
FIG. 6 is a vertical cross sectional view, to a larger scale, taken substantially along the 6—6 of FIG. 2.

Like characters of reference designate like parts in those figures of the drawings in which they occur.

Figure 1:
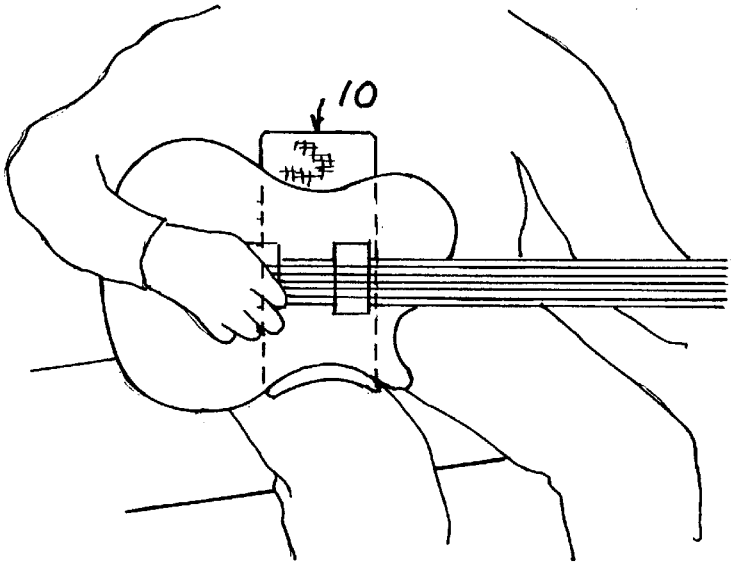
FIG. 1 is a fragmentary pictorial view of the pad in place when supporting a musical instrument.
Figure 4:
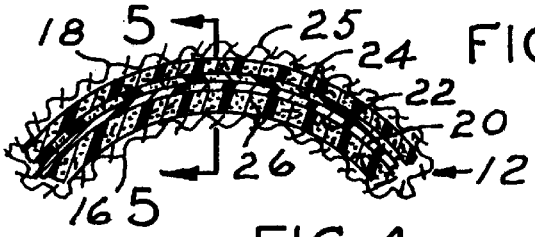
FIG. 4 is a vertical cross sectional view taken substantially along the line 4—4 of FIG. 3.
Figure 5:
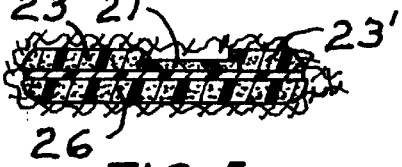
FIG. 5 is a vertical cross sectional view, to a larger scale, taken substantially along the line 5—5 of FIG. 4.
Figure 2:
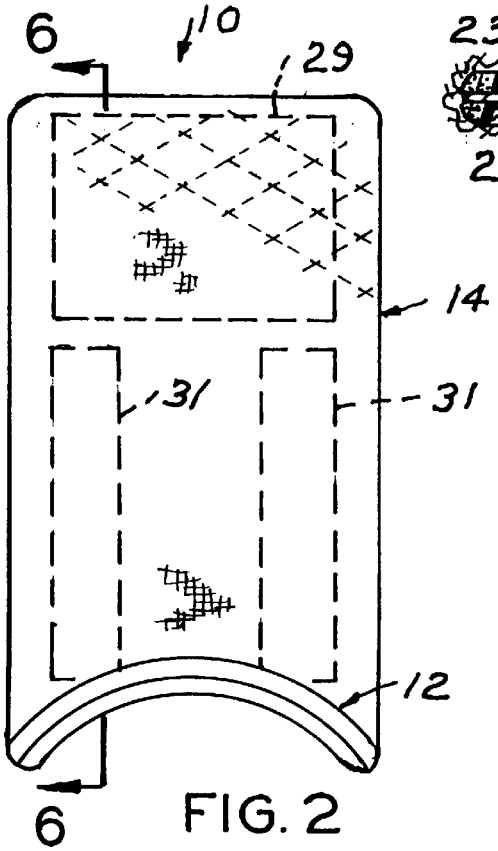
FIG. 2 is a front elevational view of the pad in operative position.
Figure 3:
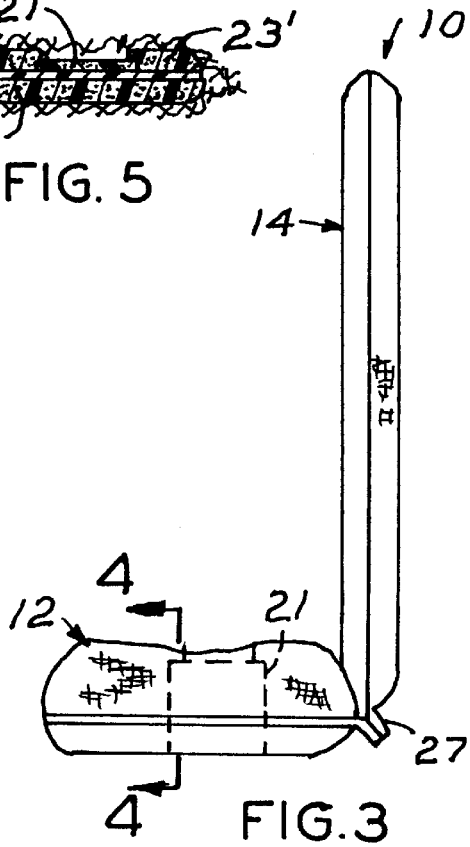
FIG. 3 is a side elevational view of FIG. 2.

In the drawings:

The reference numeral 10 generally indicates the musical instrument support pad which is elongated rectangular in plan view, and defines a generally L-shape (FIG. 2) when in use, having a foot portion 12 forming a user's thigh pad and an elongated leg portion 14 forming a user's chest pad. When in use, the foot portion 12 overlies a user's thigh under a musical instrument body, and the leg portion 14 is interposed between the musical instrument body and the user's chest, as illustrated by FIG. 1.

The generally horizontally disposed foot portion 12 is characterized by a concave lower surface 16 and an opposite convex surface 18, and, in the example shown, is approximately 13.97 cm (5½ inches) long and 15.24 cm (6 inches) wide. The concavo-convex configuration of the foot portion 12 is maintained by an internal rigid plastic member 20 similarly having a concave lower surface 22 and an opposite top convex surface 24.

In end view, the plastic member 20 substantially describes, a chord of a 15.24 cm (6 inches) diameter 13.97 cm (5½ inches) long cylinder (not shown) obtained by, a secant 14.13 cm (59/16 inches) in length coextensively severing the cylinder wall. Obviously the member 20 may be molded on 7.62 cm (3 inch) radius with the width and length dimensions equal with the above described dimensions. A resilient 3 mm (3/64 inch) thick×4 cm (1.57 inch) wide strip of dense foam rubber 21 is transversely bonded to the convex surface of the concavo-convex member 20 between cushion foam material sections 23 and 23' similarly bonded thereto. The concave surface of the member 20 is bonded to a layer of foam material 26 to cushion the mass of a musical instrument. The outer surface of the foot portion comprises a sheet of durable quilted material, such as diamond stitched quilting material 25. The foot pad 12 is hingedly connected at one end portion to one end portion of the leg member 14 as presently described.

The leg pad 14 is substantially equal in width with respect to the transverse width of the foot pad 12 and, in the example shown, is 29.21 cm (11½ inches) in length. The cover of the leg pad 14 is similarly formed from the quilted material 25 which is joined, as by stitching, to one end of the foot pad 12 to form a hinge 27 permitting the foot pad 12 and the leg pad 14 to conform to the generally horizontal position of the user's thigh and generally vertical position of the users torso, respectively (FIG. 1).

The leg pad 14 similarly has a plastic reinforcing plate 28, substantially 0.13 cm (⅛ inch) thick by 10 cm (3.94 inches) long by 7 cm (2.76 inches) in width. The reinforcing chest plate 28 is generally centrally located between the sides adjacent the upper limit of the leg pad 14. Similarly, the leg pad is provided with a layer of foam material 30 bonded to the surface of the plate 28 on that side facing the user's chest. A 3 mm (3/64 inch) thick rectangular section of dense foam rubber 29, having overall perimeter dimensions slightly greater than the reinforcing plate 28, overlies the latter and is bonded thereto. Additionally, a pair of leg pad stiffeners 31 comprising 3 mm (3/64 inch) thick strips of dense foam 3 cm wide (1.18 inches) by 15 cm (5.91 inches) long are longitudinally bonded in laterally spaced relation to the foam material 30 on its surface containing the dense foam section 29.

As mentioned above, quilted material encloses the chest reinforcing plate 28 and is similarly in-seam stitched together along its perimeter.

Obviously the invention is susceptible to changes or alterations without defeating its practicability. Therefore, I do not wish to be confined to the preferred embodiment(s) shown in the drawing(s) and described herein.

I claim:

1. A generally L-shaped cushion for a stringed musical instrument, the instrument including a body portion having a downwardly facing concave surface when the instrument is disposed in a playing position, comprising:

a foot pad forming a generally horizontal base having quilted fabric surrounding a transversely disposed rigid concavo-convex member overlying a coextensive section of resilient cushion material;

a generally upright leg pad having quilted fabric surrounding a planar plate adjacent a section of resilient cushion material; and, hinge means formed by the fabric of said base pad and said leg pad along an edge common to said base pad and said leg pad for vertical pivoting movement of said base pad and said leg pad toward and away from each other and wherein said musical instrument is placed on the foot pad.

2. A generally L-shaped cushion for a stringed musical instrument, the instrument including a body portion having a downwardly facing concave surface when the instrument is disposed in a playing position, comprising:

base pad means including an outer fabric surrounding a rigid concavo-convex member overlying a coextensive section of resilient cushion material and defining a transverse concavo-convex configuration for cushioning the mass imposed on a user's thigh by the concave surface of said instrument;

leg pad means having fabric surrounding planar panel members superposed on a section of resilient cushion material for cushioning the mass imposed on a user's torso by the body of the stringed instrument; and, hinge means formed by the fabric of said base pad and said leg pad along an edge common to said base pad and said leg pad for vertical pivoting movement about a horizontal axis of said base pad and said leg pad relative to each other and wherein said musical instrument is placed on the foot pad.

3. The stringed instrument cushion according to claim 2 in which the base pad means further includes:

a coextensive strip of resilient dense foam material centrally extending transversely of said rigid concavo-convex member; and, coextensive sections of cushion foam material disposed on opposite sides of said strip.

4. The stringed instrument cushion according to claim 3 in which the leg pad means further includes;

a mass distributing rigid plate bonded to and disposed between lateral limits adjacent the upper limit of said elongated section of resilient material; and, a resilient section of dense foam rubber bonded to and overlying and projecting beyond the boundaries of said rigid plate.

5. The stringed instrument cushion according to claim 4 in which the leg pad means further includes:

a pair of dense foam material strap members longitudinally secured to said resilient cushion material in laterally spaced depending relation.

* * * * *